US006742204B1

(12) United States Patent
Barker

(10) Patent No.: US 6,742,204 B1
(45) Date of Patent: Jun. 1, 2004

(54) REMOTE CONTROLLED MOTORIZED TRAY UNIT FOR USE ON A BED

(76) Inventor: Gary P. Barker, 5320 Duralite St., Apt. 202, Las Vegas, NV (US) 89122

( * ) Notice: Subject to any disclaimer, the term of this patent is extended or adjusted under 35 U.S.C. 154(b) by 0 days.

(21) Appl. No.: 10/403,593

(22) Filed: Apr. 1, 2003

(51) Int. Cl.[7] ..... A47B 23/00; A47C 21/00
(52) U.S. Cl. ..... 5/507.1; 108/49
(58) Field of Search ..... 5/507.1, 503.1, 5/658; 108/49

(56) References Cited

U.S. PATENT DOCUMENTS

| | | | | | |
|---|---|---|---|---|---|
| 2,669,495 | A | | 2/1954 | Foote | |
| 2,709,818 | A | * | 6/1955 | Freese | 5/507.1 |
| 3,086,226 | A | * | 4/1963 | Kyser et al. | 5/507.1 |
| 3,185,113 | A | | 5/1965 | Nathan et al. | |
| 3,535,720 | A | * | 10/1970 | Woods | 5/507.1 |
| 3,854,155 | A | * | 12/1974 | Picard | 5/507.1 |
| 4,431,154 | A | | 2/1984 | Hamm | |
| D280,788 | S | | 10/1985 | Levin | |
| D281,555 | S | | 12/1985 | Levy | |
| D281,937 | S | | 12/1985 | Roczey | |
| 4,780,919 | A | * | 11/1988 | Harrison | 5/507.1 |
| D319,357 | S | | 8/1991 | Horne | |
| D324,791 | S | | 3/1992 | Hoover | |
| 5,359,741 | A | | 11/1994 | Lang | |

* cited by examiner

*Primary Examiner*—Alexander Grosz
(74) *Attorney, Agent, or Firm*—Donald R. Schoonover

(57) ABSTRACT

A tray unit is mounted on a rail adjacent to a bed and includes a motor driven tray that can move along the rail. A remote control unit controls operation of the tray so the tray can be moved by a bedridden person into a position convenient for the person.

1 Claim, 1 Drawing Sheet

REMOTE CONTROLLED MOTORIZED TRAY UNIT FOR USE ON A BED

BACKGROUND OF THE INVENTION

1. Field of the Invention

The present invention relates to the general art of beds, and to the particular field of accessories for beds.

2. Discussion of the Related Art

Many people become bedridden for various times. These times can vary from a day or two to permanent. Such bedridden people often eat in bed as well as watch television, read, work or the like while they remain bedridden. The art contains many examples of trays and supports that can be used for these purposes.

Most of the known trays and supports require a person to place the tray or support in position adjacent to the bedridden person so that person can use the tray or support. After use, the tray or support must be removed which, again, requires the assistance of someone other than the bedridden person. Thus, the person is dependent on someone else to carry out such a basic task. This requires the bedridden person to wait for meals, and/or for cleanup after meals until someone can assist them. This is inconvenient and poor for morale.

Still further, once a tray is positioned, a bedridden person may shift his or her position. This may place the person in an awkward position relative to the tray. The person may then have to request further assistance in re-positioning the tray.

Furthermore, as mentioned above, bed trays are often multi-use items which support books, work, and the like, in addition to food trays and items associated with eating. Each use may have an ideal position relative to the bedridden person, and each of these positions may be different from other positions. Thus, each time a bedridden person desires to change a use of the tray, he may be forced to request assistance.

Therefore, there is a need for a support tray for use by a bedridden person which can be moved into the most effective location without assistance.

Presently, bed trays are often stored away from a bed in order to keep them out of the way when they are not in use. This requires assistance and produces the above-discussed drawbacks. This also may be wasteful of valuable space.

Therefore, there is a need for a support tray for use by a bedridden person which can be stored in a location that is readily accessible when needed so no assistance is required to move the tray into a use position.

PRINCIPAL OBJECTS OF THE INVENTION

It is a main object of the present invention to provide a support tray adjacent to a bed.

It is another object of the present invention to provide a support tray for use by a bedridden person which can be moved into the most effective location without assistance.

It is another object of the present invention to provide a support tray for use by a bedridden person and which can be stored in a location that is readily accessible when needed so no assistance is required to move the tray into a use position.

SUMMARY OF THE INVENTION

These, and other, objects are achieved by a bed tray unit which comprises a bed having a head section, a foot section, two sides, a longitudinal axis extending between the head section and the foot section, and a transverse axis extending between the two sides; a tray-mounting rail connected at one end thereof to the foot section of the bed and at a second end thereof to the head section of the bed and extending in the direction of the longitudinal axis of the bed, the tray-mounting rail being located adjacent to one side of the bed; a tray unit movably mounted on the tray-mounting rail to move between adjacent to the foot section of the bed and adjacent to the head section of the bed; a motor unit mounted on the tray unit and having a rotatable output shaft; a roller mounted on the output shaft of the motor unit for rotation therewith and engaging the tray-mounting rail; and a control unit connecting the motor unit to a power source when the control unit is in an "on" condition.

The bedridden person can move the tray out of the way when the tray is not in use, but can also move the tray into the most effective position when desired without requiring any assistance from someone else.

BRIEF DESCRIPTION OF THE DRAWING FIGURES

DETAILED DESCRIPTION OF THE PREFERRED EMBODIMENT

Other objects, features and advantages of the invention will become apparent from a consideration of the following detailed description and the accompanying drawings.

Referring to the Figures, it can be understood that the present invention is embodied in a bed tray unit 10 that can be used to locate a bed tray in either a stored location when not in use or in a position that is most convenient for a person in a bed. Bed unit 10 can be positioned as desired by the person in the bed without requiring assistance from anyone else.

Figure 2:
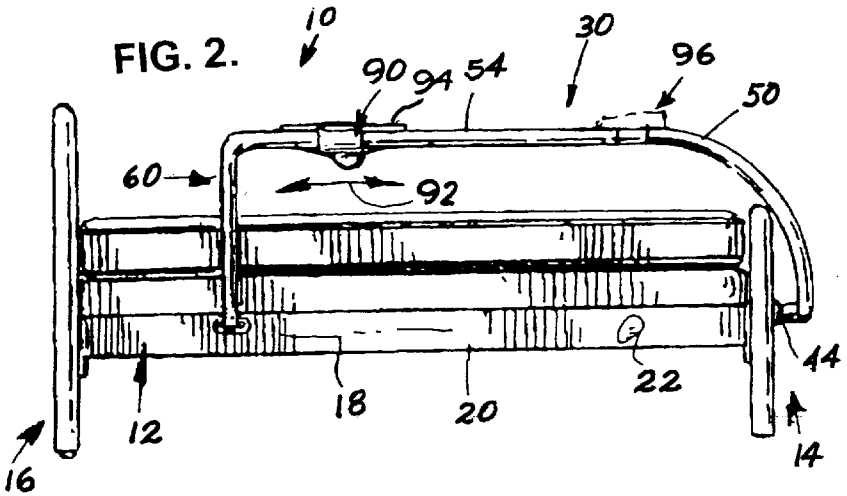
FIG. 2 is a side elevational view of a bed with the bed tray unit of the present invention mounted thereon.

As shown in the figures, bed unit 10 comprises a bed unit 12 which includes a foot section 14, a head section 16, and a longitudinal axis 18 extending between foot section 14 and head section 16. First and second sides, such as side 20 shown in FIG. 2, are both identical and are on opposite sides of a centerline of the bed unit. A transverse axis, indicated in FIG. 2 by indicator 22, extends into the plane of the paper with FIG. 2 thereon, and extends between the first and second sides 20 of the bed unit 12.

A tray-mounting rail 30 is located adjacent to side 20 of the bed unit and includes a foot portion 32 which includes a J-shaped mounting plate supporting section 34. The J-shaped mounting plate supporting section 34 includes a first end 36 and a second end 38 as well as a curved portion 40. A linear portion 42 is located in a horizontal plane and extends in the direction of transverse axis 22 of the bed unit 12. A foot end mounting plate 44 on second end 38 of the foot portion 32 is fixed to foot section 14 of the bed unit when the tray-mounting rail 30 is mounted on the bed unit 12 as shown in FIG. 2.

A curvilinear central section 48 of tray-mounting rail 30 has a curved section 50 which has a first end 52 connected to the first end 36 of the foot portion 32 of the tray-mounting rail 30 and is contained in a vertical plane and is spaced apart from the plane containing curved portion 40 of the J-shaped mounting plate supporting section 34. Curved section 50 is spaced apart from first end 36 of the foot portion 32 of the tray-mounting rail 30. A linear section 54 is connected to curved section 50 of the curvilinear central section 48 and extends in the direction of the longitudinal axis 18 of the bed unit 12. Linear section 54 has a second end 56 located near head section 16 of the bed unit 12.

Tray-mounting rail 30 further includes a head section 60 which includes a first curved portion 62 connected to second end 56 of the linear section 54 of the curvilinear central section 48 and is contained in the vertical plane. Head section 60 further includes a linear portion 64 having a first end 66 connected to first curved portion 62 of head section 60 and is contained in the vertical plane. Linear portion 64 of the head section 60 further including a second end 68.

A second curved portion 70 of the head section 60 has a first end 72 connected to second end 68 of linear portion 64 of the head section 60 and is contained in the vertical plane. Second curved portion 70 includes a second end 76 and a linear section 78 which has a first end 80 connected to second end 76 of the second curved portion 70 of the head section 60 and extends in the direction of the transverse axis 22 of the bed unit 12. Second curved portion 70 further includes a second end 82. A head end mounting plate 86 is mounted on the second end 82 of the linear section 78 of the head section 60 and is fixed to head section 16 of the bed unit 12 when the tray-mounting rail 30 is mounted on the bed unit 12.

A tray unit 90 is movably mounted on the tray-mounting rail 30 to move on the central section of the tray-mounting rail 30 between adjacent to the foot portion 32 of the tray-mounting rail 30 and adjacent to the head section 60 of the tray-mounting rail 30. This movement is indicated in FIG. 2 by double-headed arrow 92 with the tray 90 being shown in a use position 94 in FIG. 2 with a stored position being indicated in dotted lines at position 96 in FIG. 2.

The tray unit 90 includes a connecting arm 100 slidably mounted on the tray mounting rail 30. The connecting arm 100 includes a rail-encircling portion 102 and a hollow arm 104. The connecting arm 100 of the tray unit 90 extends in the direction of the transverse axis 22 of the bed unit 12 and has a distal end 106 spaced apart from the rail-encircling portion 102.

A food-supporting tray 108 is connected to the distal end 106 of the connecting arm 100 and includes a first end 110 connected to the distal end 106 of the connecting arm 100, a second end 112 spaced apart from the first end 110 of the tray 108 in the direction of the transverse axis 22 of the bed unit 12, a tray longitudinal axis 114 which extends between the first end 110 of the tray 108 and the second end 112 of the tray 108 and which extends in the direction of the transverse axis 22 of the bed unit 12, a first side 116, a second side 118, a tray transverse axis 120 which extends between the first side 116 of the tray 108 and the second side 118 of the tray 108 and extends in the direction of the longitudinal axis 18 of the bed unit 12, a tray bottom surface 122, and a tray top surface 124. A plurality of indentations, such as cup holder indentation 126, bowl holder indentation 128 and utensil holder indentation 130 are defined in the tray top surface 124. Other indentations can be used without departing from the scope of the present disclosure, and the indentations shown are considered as examples of the many different types of indentation that can be used as will occur to those skilled in the art based on the teaching of the present disclosure.

Figure 4:
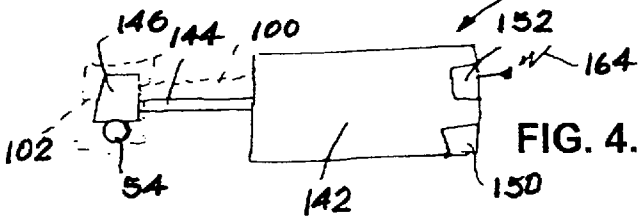
FIG. 4 is a schematic indicating a motor unit that is used in the bed tray unit embodying the present invention.

A motor unit 140 is shown in FIG. 4 and is mounted on the tray unit 90 and includes a motor 142 mounted on tray bottom surface 122. Motor 142 can be any suitable motor, including an electric motor, or the like, as will occur to those skilled in the art. A drive shaft 144 is connected to the motor 142 for rotation and extends through the hollow arm 104 of the connecting arm 100 of the tray unit 90. A drive roller 146 is mounted on the drive shaft 144 of the motor unit 140 for rotation therewith. Drive roller 146 is located in rail-encircling portion 102 of the connecting arm 100 of the tray unit 90. The drive roller 146 engages the central section of the tray mounting rail as by friction or by a gear on the drive roller and a rack in the central section, or the like.

A power source 150, such as a battery pack or the like, is associated with the motor 142. A control unit 152 connects the power source 150 to the motor 142 when the control unit 152 is in an "on" configuration and disconnects the motor 142 from the power source 150 when the control unit 152 is in an "off" configuration.

Figure 3:
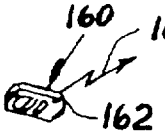
FIG. 3 is a perspective view of a remote control unit used to control the bed tray unit of the present invention.
Figure 1:
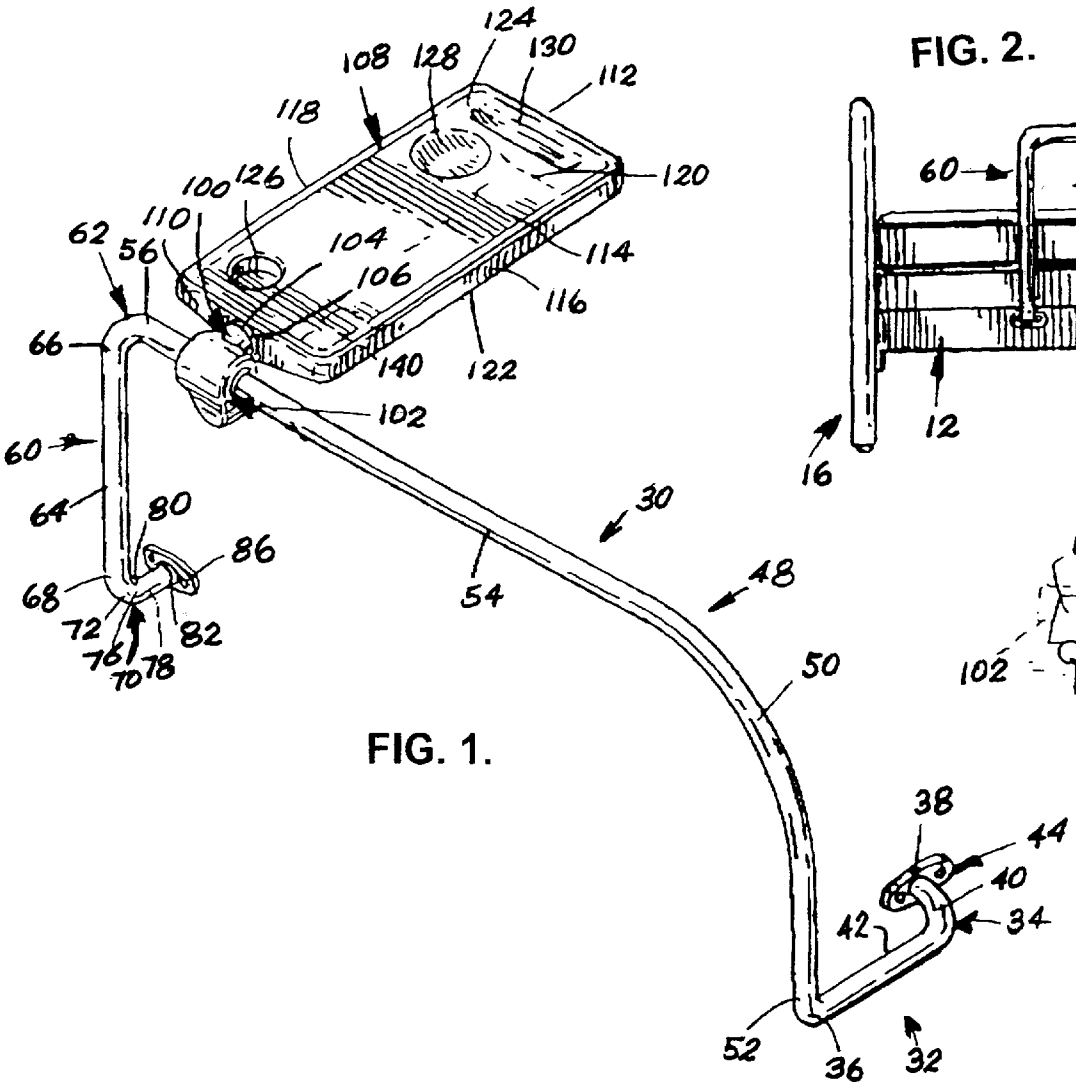
FIG. 1 is a perspective view of a bed tray unit embodying the present invention.

A remote control unit 160 is shown in FIG. 3 and includes a transmitter 162 for transmitting a control signal 164 to the control unit 152 of the motor unit 140.

A person merely operates the remote control unit 160 to move the tray 108 into the desired location. The remote control unit 160 can have a forward button which connects the motor 142 to the power source 150 in one direction to move the tray from the dotted line position 96 shown in FIG. 2 toward the solid line position 94 shown in FIG. 2, a reverse button which connects the motor 142 to the power source 150 in a manner to move the tray 108 in a direction from the solid line position 94 shown in FIG. 2 to the dotted line position 96 shown in FIG. 2, and an "off" button which disconnects the motor 142 from the power source 150 and thus turns the motor 142 off, and an "on" button which connects the motor 142 to the power source 150 to turn the motor 142 on (with the motor 142 disconnected from the drive shaft 144 and thus "idles" the motor 142) to simply turn the motor 142 on. Other configurations can be envisioned by those skilled in the art based on the teaching of the present disclosure and such other configurations are intended to be included in the scope of the present disclosure.

It is understood that while certain forms of the present invention have been illustrated and described herein, it is not to be limited to the specific forms or arrangements of parts described and shown.

What is claimed and desired to be covered by letters

1. A bed tray unit comprising:

a) a bed unit which includes
   (1) a foot section,
   (2) a head section,
   (3) a longitudinal axis extending between the foot section of said bed unit and the head section of said head unit,
   (4) first and second sides, and
   (5) a transverse axis extending between the first and second sides of said bed unit;

b) a tray mounting rail located adjacent to one side of the first and second sides of said bed unit and which includes
   (1) a foot portion which has a J-shaped mounting plate supporting section, the J-shaped mounting plate supporting section including a
      (A) first end and a second end,
      (B) a curved portion,
      (C) a linear portion, with the linear portion being located in a horizontal plane and extending in the direction of the transverse axis of said bed unit, and (D) a foot end mounting plate on the second end of the foot portion of said tray mounting rail and being fixed to the foot section of said bed unit when said tray mounting rail is mounted on said bed unit, (2) a curvilinear central section having (A) a curved section having a first end connected to the first end of the foot portion of said tray mounting rail and being contained in a vertical plane and which is spaced apart from the plane containing the curved portion of the J-shaped mounting plate supporting section and which is spaced apart from the first end of the foot portion of said tray mounting rail, and (B) a linear section which is connected to the curved section of the curvilinear central section and which extends in the direction of the longitudinal axis of said bed unit and which has a second end located near the head section of said bed unit, (3) a head section which includes (A) first curved portion connected to the second end of the linear section of the curvilinear central section and is contained in the vertical plane, (B) a linear portion having a first end connected to the first curved portion of the head section and which is contained in the vertical plane, the linear portion of the head section further including a second end, (C) a second curved portion having a first end connected to the second end of the linear portion of the head section and which is contained in the vertical plane and which includes a second end, and (D) a linear section which has a first end connected to the second end of the second curved portion of the head section and which extends in the direction of the transverse axis of said bed unit and which has a second end, and (4) a head end mounting plate on the second end of the linear section of the head section and which is fixed to the head section of said bed unit when said tray mounting rail is mounted on said bed unit;

c) a tray unit movably mounted on said tray mounting rail to move on the central section of said tray mounting rail between adjacent to the foot portion of said tray mounting rail and adjacent to the head portion of said tray mounting rail, said tray unit including (1) a connecting arm slidably mounted on said tray mounting rail, the connecting arm including a rail encircling portion and a hollow arm, the connecting arm of said tray unit extending in the direction of the transverse axis of said bed unit and having a distal end spaced apart from the rail encircling portion, (2) a food-supporting tray connected to the distal end of the connecting arm, and including (A) a first end connected to the distal end of the connecting arm, (B) a second end spaced apart from the first end of the tray in the direction of the transverse axis of said bed unit, (C) a tray longitudinal axis which extends between the first end of the tray and the second end of the tray and which extends in the direction of the transverse axis of said bed unit, (D) a first side, (E) a second side, (F) a tray transverse axis extending between the first side of the tray and the second side of the tray and in the direction of the longitudinal axis of said bed unit, (G) a tray bottom surface, (H) a tray top surface, and (I) a plurality of indentations defined in the tray top surface;

d) a motor unit mounted on said tray unit and including (1) a motor mounted on the tray bottom surface, (2) a drive shaft connected to the motor for rotation, the drive shaft extending through the hollow arm of the connecting arm of said tray unit, and (3) a drive roller mounted on the drive shaft of said motor unit for rotation therewith, the drive roller being located in the rail encircling portion of the connecting arm of said tray unit, the drive roller engaging the central section of said tray mounting rail, (4) a power source associated with the motor, and (5) a control unit connecting the power source to the motor when the control unit is in an "on" configuration and disconnecting the motor from the power source when the control unit is in an "off" configuration; and e) a remote control unit having a transmitter for transmitting a control signal to the control unit of said motor unit.

* * * * *